US006233969B1

(12) United States Patent
Yamauchi et al.

(10) Patent No.: US 6,233,969 B1
(45) Date of Patent: May 22, 2001

(54) DECOMPRESSION DEVICE-INTEGRATED HEAT EXCHANGER FOR REFRIGERANT CYCLE

(75) Inventors: Yoshiyuki Yamauchi, Chita-gun; Ken Yamamoto, Obu; Minoru Ohta, Chiryu, all of (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/457,403

(22) Filed: Dec. 8, 1999

(30) Foreign Application Priority Data

Dec. 9, 1998 (JP) ..... 10-350309

(51) Int. Cl.[7] ..... F25B 41/00
(52) U.S. Cl. ..... 62/513; 62/113
(58) Field of Search ..... 62/513, 113, 511, 62/204, 205, 206, 210, 211, 212, 222, 223, 224, 225

(56) References Cited

U.S. PATENT DOCUMENTS 1,830,314 11/1931 De Remer ..... 62/513 X
4,259,848 4/1981 Voigt ..... 62/113
5,568,736 10/1996 Nivens ..... 62/513
6,105,386 8/2000 Kuroda et al. ..... 62/513

*Primary Examiner*—Harry B. Tanner
(74) *Attorney, Agent, or Firm*—Harness, Dickey & Pierce, PLC

(57) ABSTRACT

In a decompression device-integrated heat exchanger, a pressure-reducing unit for reducing high-pressure refrigerant of a refrigerant cycle, and an inner heat-exchanging unit for performing heat-exchange between high-pressure refrigerant before being decompressed in the pressure-reducing unit and low-pressure refrigerant after being decompressed in the pressure reducing unit are integrated to each other. The inner heat-exchanging unit has a high-pressure tube through which high-pressure refrigerant flows, and a low-pressure tube through which low-pressure refrigerant flows. Both the tubes are wound around a case of the pressure-reducing unit, and are brazed to the case on contacting portions therebetween. Further, in each tube, wall thickness of the contacting portion is made thinner than that of the other portion. Thus, the decompression device-integrated heat exchanger has a reduced weight, while having a simple structure.

17 Claims, 3 Drawing Sheets

DECOMPRESSION DEVICE-INTEGRATED HEAT EXCHANGER FOR REFRIGERANT CYCLE

CROSS-REFERENCE TO RELATED APPLICATION

This application is related to and claims priority from Japanese Patent Application No. Hei. 10-350309 filed on Dec. 9, 1998, the contents of which are hereby incorporated by reference.

BACKGROUND OF THE INVENTION

1. Field of the Invention

The present invention relates to a decompression device-integrated heat exchanger in which a pressure-reducing unit and a heat-exchanging unit of a refrigerant cycle are integrated. In the heat-exchanging unit, high-pressure refrigerant before being decompressed in the pressure-reducing unit is heat-exchanged with low-pressure refrigerant after being decompressed in the pressure-reducing unit. The decompression device-integrated heat exchanger is suitably used for a supercritical refrigerant cycle in which pressure of high-pressure refrigerant discharged from a compressor exceeds the critical pressure of refrigerant.

2. Description of Related Art

In a conventional refrigerant cycle, an enthalpy difference between an inlet side and an outlet side of an evaporator is enlarged by setting the enthalpy of refrigerant at the inlet side of the evaporator to be smaller, so that refrigerant capacity of the refrigerant cycle is improved. However, in this case, an inner heat-exchanging unit is need for performing heat exchange between high-pressure refrigerant and low-pressure refrigerant. Therefore, a new attachment space and a mounting step for mounting the inner heat-exchanging unit are necessary.

SUMMARY OF THE INVENTION

In view of the foregoing problems, it is an object of the present invention to provide a decompression device-integrated heat exchanger in which a pressure-reducing unit and a heat-exchanging unit are integrated, while coefficient of performance of a refrigerant cycle is improved.

According to the present invention, a decompression device-integrated heat exchanger for a refrigerant cycle includes a pressure-reducing unit for reducing pressure of refrigerant in the refrigerant cycle, and a heat-exchanging unit integrated with the pressure-reducing unit, for performing heat-exchange between high-pressure refrigerant before being decompressed in the pressure-reducing unit and low-pressure refrigerant after being decompressed in the pressure-reducing unit. The heat-exchanging unit includes a first tube through which the high-pressure refrigerant flows, and a second tube through which the low-pressure refrigerant flows. The first and second tubes are disposed to be wound around a case of the pressure-reducing unit while the first and second tubes are contact. Thus, in the decompression device-integrated heat exchanger, the case of the pressure-reducing unit is used as an inner solid member of the first and second tubes. As a result, even when exterior force is applied to the first and second tubes, the tubes are prevented from being bent and deformed.

Preferably, the second tube is disposed between the case and the first tube. Therefore, low-pressure refrigerant flowing through the second tube is heat-exchanged with high-pressure refrigerant flowing through the first tube and refrigerant within the case of the pressure-reducing unit. Therefore, coefficient of performance of the refrigerant cycle is further improved.

Preferably, the first tube has a first contacting portion contacting the second tube, and the first contacting portion has a wall thickness thinner than that of the other portion of the first tube. Similarly, the second tube has a second contacting portion contacting the first tube, and the second contacting portion has a wall thickness thinner than that of the other portion of the second tube. Because the first and second contacting portions of the first and second tubes are not exposed outside, the first and second contacting portions are hardly corroded. Thus, the weight of the heat-exchanging unit is reduced while corrosion of the tubes is prevented. Further, because each wall thickness of the contacting portions of the tubes is made thinner, heat-exchanging performance between high-pressure refrigerant and low-pressure refrigerant can be improved.

BRIEF DESCRIPTION OF THE DRAWINGS

Additional objects and advantages of the present invention will be more readily apparent from the following detailed description of a preferred embodiment when taken together with the accompanying drawings, in which.

DETAILED DESCRIPTION OF THE PRESENTLY PREFERRED EMBODIMENT

A preferred embodiment of the present invention will be described hereinafter with reference to FIGS. 1–4. In the embodiment, a decompression device-integrated heat exchanger in which a pressure-reducing unit 300 and an inner heat-exchanging unit 600 are integrated is typically applied to a supercritical refrigerant cycle.

Figure 1:
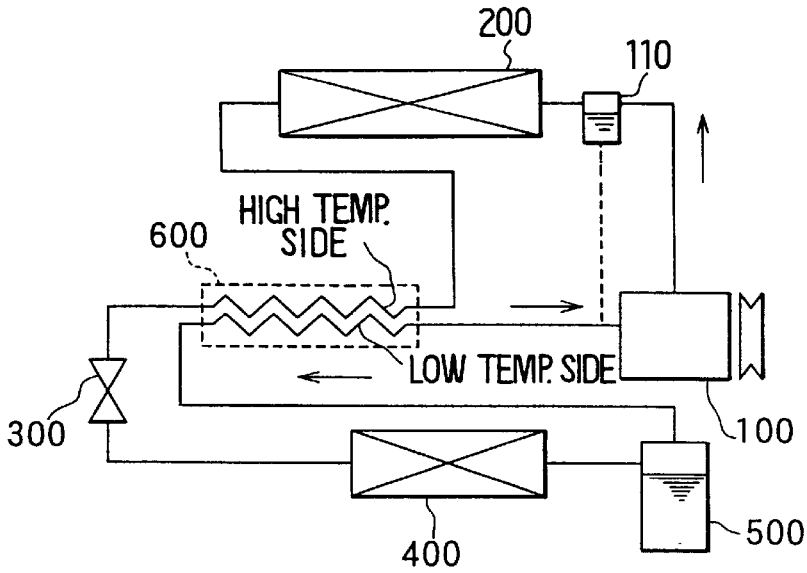
FIG. 1 is a schematic view of a supercritical refrigerant cycle according to a preferred embodiment of the present invention.

As shown in FIG. 1, the refrigerant cycle includes a compressor 100 for compressing refrigerant (e.g., $CO_2$ refrigerant), a radiator 200 for cooling refrigerant by performing heat exchange between refrigerant and outside air, an oil separator 110 for separating lubricating oil and refrigerant discharged from the compressor 100, the pressure-reducing unit (pressure control valve) 300 for decompressing pressure of refrigerant from the radiator 200, an evaporator 400 for cooling air by evaporating refrigerant decompressed in the pressure-reducing unit 300, an accumulator 500, and the heat-exchanging unit 600 integrated with the pressure-reducing unit 300.

Figure 2:
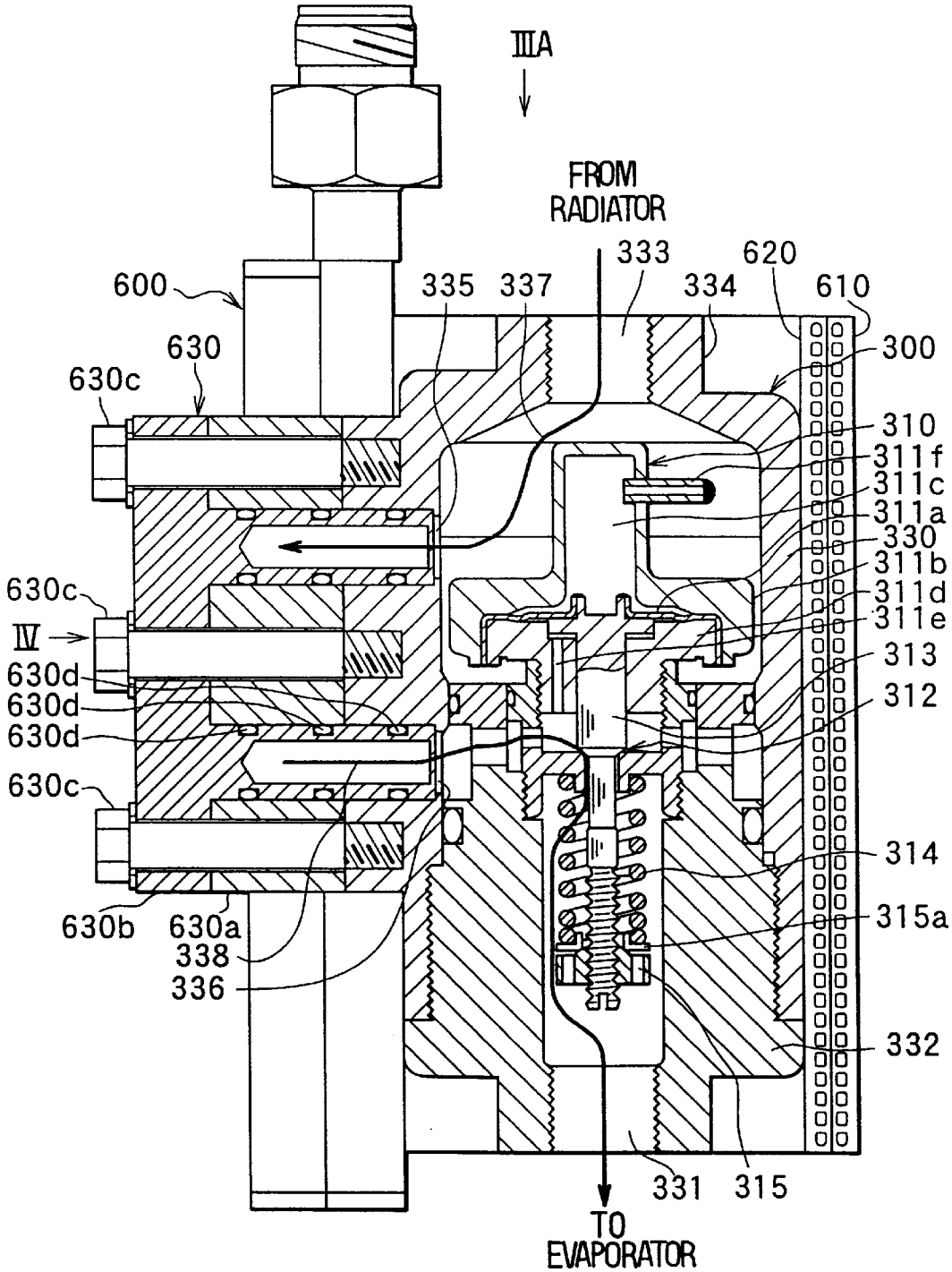
FIG. 2 is a sectional view of a decompression device-integrated heat exchanger according to the embodiment.

The compressor 100 is driven by a vehicle engine, for example, to compress refrigerant. Refrigerant containing the lubricating oil is separated in the oil separator 110, so that separated refrigerant flows toward the radiator 200 and separated lubricating oil is returned into the compressor 100. An opening degree of the pressure-reducing unit 300 is adjusted based on refrigerant temperature on an outlet side of the radiator 200 so that pressure of refrigerant on the outlet side of the radiator 200 is controlled. Refrigerant flowing from the evaporator 400 is separated into gas refrigerant and liquid refrigerant in the accumulator 500, so that liquid refrigerant is temporarily stored in the accumulator 500 and gas refrigerant flows into the compressor 100 after being heat-exchanged with high-pressure refrigerant in the inner heat-exchanging unit 600. In FIG. 1, the heat-exchanging unit 600 and the pressure-reducing unit 300 are indicated separately; however, the heat-exchanging unit 600 and the pressure-reducing unit 300 are integrated from each other as shown in FIG. 2. In the heat-exchanging unit 600, low-pressure refrigerant flowing from the accumulator 500, having been decompressed in the pressure-reducing unit 300, is heat exchanged with high-pressure refrigerant from the radiator 200 before being decompressed in the pressure-reducing unit 300.

In the embodiment of the present invention, the heat-exchanging unit 600 and the pressure-reducing unit 300 are integrated to form the decompression device-integrated heat exchanger. As shown in FIG. 2, a control valve 310 of the pressure-reducing unit 300 includes a temperature-sensing portion in which an inner pressure is changed in accordance with refrigerant temperature at the outlet side of the radiator 200. The control valve 310 is operatively linked with the temperature sensing portion so that an opening degree of a valve opening 312 of the pressure-reducing unit 300 is adjusted in accordance with the variation in the inner pressure of the temperature-sensing portion. The control valve 310 is accommodated in an approximately cylindrical case 330 of the pressure-reducing unit 300.

The case 330 includes a casing body portion 332 defining a first refrigerant outlet 331 being connected to an inlet side of the evaporator 400, and a cover portion 334 defining a first refrigerant inlet 333 being connected to the outlet side of the radiator 200. The control valve 310 is inserted into the casing body portion 332 to be fixed to the casing body portion 332. After the control valve 310 is inserted into the casing body portion 332, the cover portion 334 is connected to the casing body portion 332 to close opening of the casing body portion 332.

Further, the cover portion 334 of the case 330 has a second refrigerant outlet 335 connected to a refrigerant inlet side of the inner heat-exchanging unit 600, and a second refrigerant outlet 336 connected to a refrigerant outlet side of the inner heat-exchanging unit 600. Further, the second refrigerant outlet 335 communicates with the first refrigerant inlet 333, and the second refrigerant inlet 336 communicates with a refrigerant upstream side of the valve opening 312.

Within the case 330, a first refrigerant passage (temperature sensing chamber) 337 is formed from the first refrigerant inlet 333 to the second refrigerant outlet 335, and a second refrigerant passage 338 is formed from the second refrigerant inlet 336 to the valve opening 312.

The temperature sensing portion of the control valve 310 is provided in the first refrigerant passage 337 to detect the refrigerant temperature at the outlet side of the radiator 200. The temperature sensing portion includes a diaphragm (pressure-response member) 311*a*, a diaphragm cover 311*b* for defining a sealed space 311*c* with the diaphragm 311*a*, and a diaphragm support 311*d* for supporting and fixing the diaphragm 311*a*. The diaphragm 311*a* is inserted between the diaphragm cover 311*b* and the diaphragm support 311*d*.

Refrigerant is sealed within the sealed space 311*c* by a density (e.g., 625 kg/m$^3$) in a range between the saturated liquid density at the refrigerant temperature of 0° C. and the saturated liquid density at the critical point. On the other hand, onto a side of the diaphragm 311*a* opposite to the sealed space 311*c*, pressure of the second refrigerant passage 338 is introduced through a pressure introduction passage 311*e*. Refrigerant is sealed within the sealed space 311*c* from a sealed pipe 311*f*. The sealed pipe 311*f* is made of metal having a high heat-transmitting performance such as copper, so that the refrigerant temperature within the sealed space 311*c* is changed immediately relative to a change of the refrigerant temperature in the first refrigerant passage 337.

The opening degree of the valve opening 312 is adjusted by a valve body 313. The valve body 313 is connected to the diaphragm 311*a* to be mechanically operated with the inner pressure of the sealed space 311*c*. For example, as the inner pressure of the sealed space 311*c* increases, the valve body 313 is moved to reduce the opening degree of the valve opening 312. Further, a spring 314 is disposed so that elastic force is applied to the valve body 313 in a direction for reducing the opening degree of the valve opening 312. Thus, the valve body 313 is moved in accordance with a balance between the elastic force of the spring 314, and a pressure difference of the inside and outside of the sealed space 311*c*.

An initial setting load of the spring 314 is adjusted by turning an adjustment nut 315. The initial setting load of the spring 314 is set in such a manner that refrigerant has a predetermined super cooling degree (e.g., approximately 10° C.) in a condensing area below the critical pressure. Specifically, the initial setting load of the spring 314 is approximately 1 MPa when being converted to pressure within the sealed space 311*c*. A spring seat 315*a* is disposed between the spring 314 and the adjustment nut 315 to prevent the spring 314 and the adjustment nut 315 are directly rubbed.

In the supercritical area, the pressure-reducing unit 300 controls the refrigerant pressure at the outlet side of the radiator 200 based on the refrigerant temperature at the outlet side of the radiator 200 along the isopycnic line of 625kg/m$^3$. on the other hand, in the condensing area, the pressure-reducing unit 300 controls the refrigerant pressure at the outlet side of the radiator 200 so that the super-cooling degree of the refrigerant at the outlet side of the radiator 200 becomes a predetermined value.

Figure 3A:
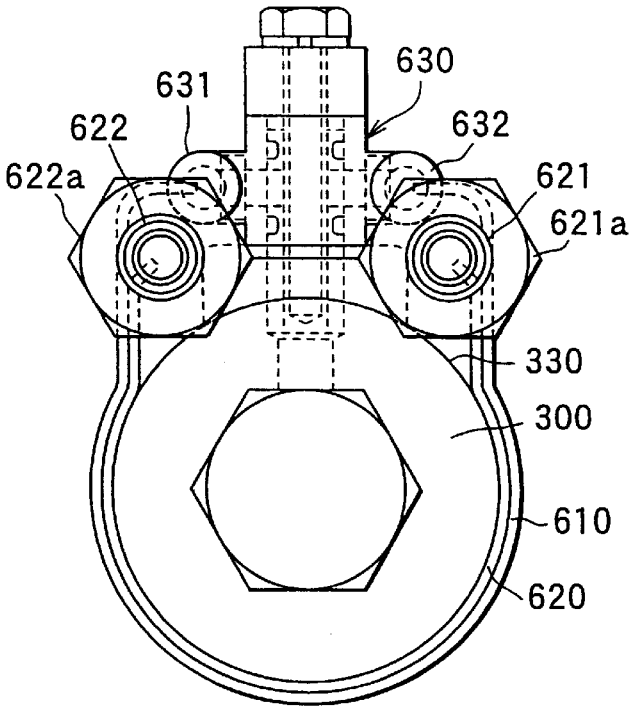
FIG. 3A is a side view taken from arrow IIIA in FIG. 2.
Figure 3B:
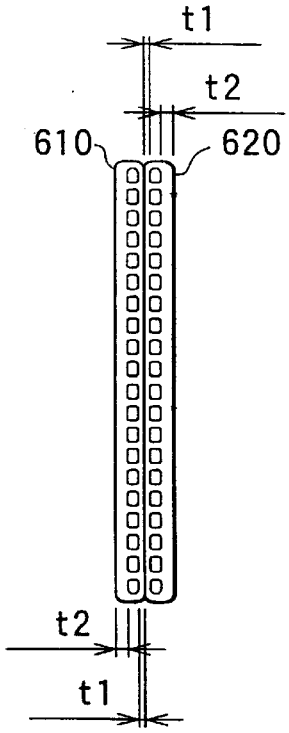
FIG. 3B is a sectional view of both tubes.

The inner heat-exchanging unit 600 includes a flat-like high-pressure tube 610 having therein plural passages through which high-pressure refrigerant flows, and a flat-like low-pressure tube 620 having therein plural passages through which low-pressure refrigerant flows. As shown in FIG. 3A, both the tubes 610, 620 are wound around the case 330 in a contacting state while being overlapped in a radial direction of the case 330. The tubes 610, 620 are connected to the case 330 by brazing the contacting surfaces therebetween. Each of the tubes 610, 620 is formed by extrusion or drawing of an aluminum material. In each of the tubes 610, 620, a wall thickness t1 at a position where the tubes 610, 620 are made contact is set to be thinner than a wall thickness t2 of the other position.

As shown in FIG. 3A, a refrigerant inlet of the high-pressure tube 610 is bonded to a first joint pipe 631 by brazing, a refrigerant outlet of the high-pressure tube 610 is bonded to a second joint pipe 632 by brazing, and both the joint pipes 631, 632 are brazed to a joint block 630 fixed to the pressure-reducing unit 300.

As shown in FIG. 2, the joint block 630 includes a block body portion 630*a* connected to both the joint pipes 631, 632, and a cap portion 630*b* for closing a part of the first refrigerant passage 337 and the second refrigerant passage 338 formed in the block body portion 630*a*. The block body portion 630*a* and the cap portion 630*b* are fixed to the case 330 of the pressure-reducing unit 300 by hexagon bolts 630*c* each having a hole therein.

Round rings 630*d* are disposed to prevent refrigerant from leaking from a clearance between the block body portion 630*a* and the cap portion 630*b*.

Figure 4:
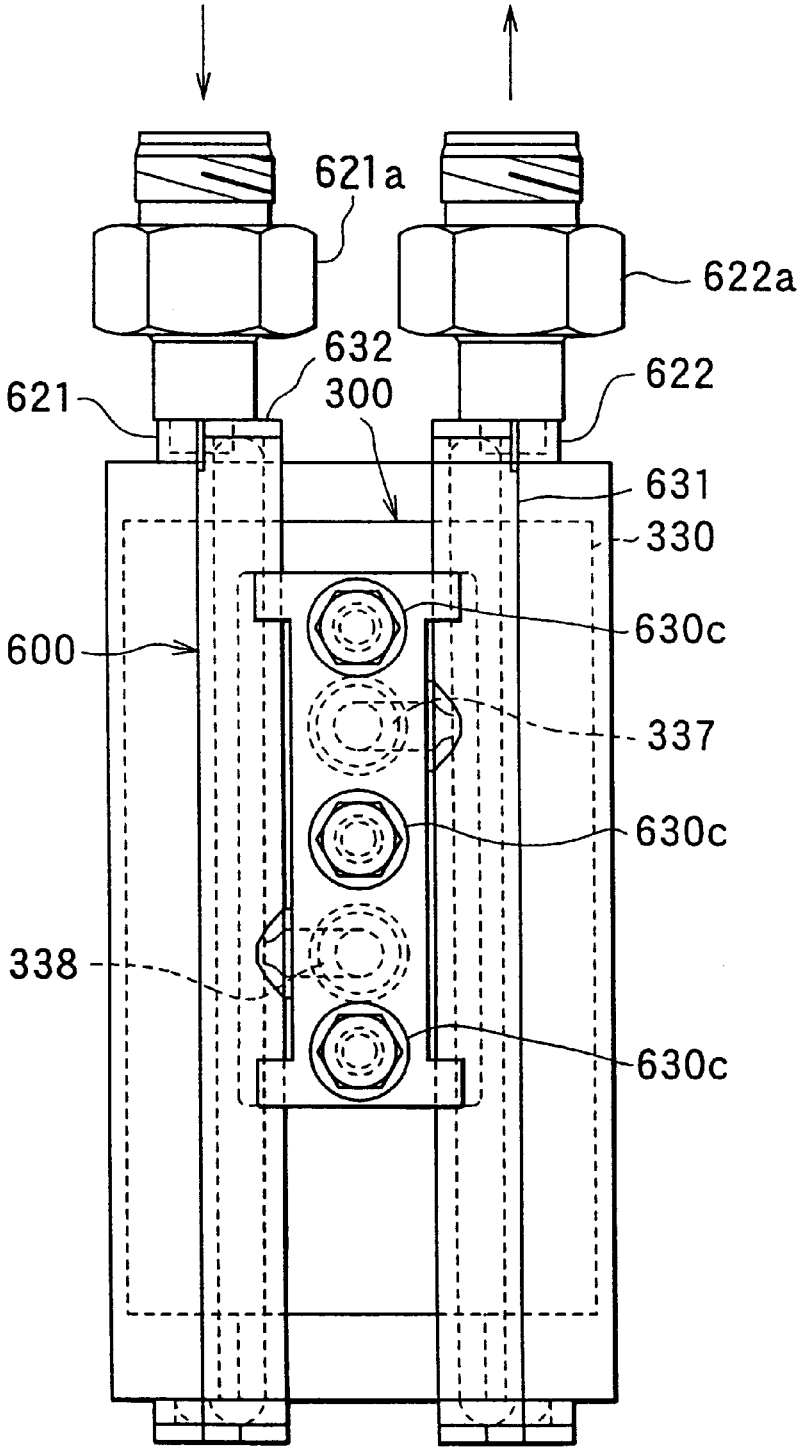
FIG. 4 is a side view taken from arrow IV in FIG. 2.

Further, as shown in FIG. 3A, a refrigerant inlet and a refrigerant outlet of the low-pressure tube 620 are brazed to third and fourth joint pipes 621, 622 shown in FIG. 4, respectively. The third and fourth joint pipes 621, 622 are disposed so that a refrigerant flow direction in the low-pressure tube 620 and a refrigerant flow direction in the high-pressure tube 610 are reverse to each other. The third and fourth joint pipes 621 are connected to refrigerant pipes through union portions 621*a*, 622*a*, respectively.

According to the present invention, both the tubes 610, 620 are wound around the case 330 while adjacent two of the case 330 and the tubes 610, 620 contact. Therefore, even when exterior force is applied to the tubes 610, 620, the tubes 610, 620 are prevented from being bent and deformed, because the case 330 of the pressure-reducing unit 300 is used as an inner solid member. Further, because the low-pressure tube 620 is placed between the casing 330 and the high-pressure tube 610, refrigerant flowing through the low-pressure tube 620 is heat-exchanged with refrigerant flowing through the high-pressure tube 610 and refrigerant flowing through the first refrigerant passage 337 and the second refrigerant passage 338 of the pressure-reducing unit 300. Thus, an enthalpy difference between the inlet side and the outlet side of the evaporator 400 is further enlarged, and the refrigerant capacity and coefficient of performance of the refrigerant cycle can be further improved.

Each wall thickness of the tubes 610, 620 is necessary to be determined based on corrosion in addition to the pressure of refrigerant flowing though the tubes 610, 620. However, because the contacting portion on which both the tubes 610, 620 contact is not exposed by outside air, the corrosion is hardly caused in the contacting portion between the tubes 610, 620. Thus, in the embodiment of the present invention, the wall thickness t1 of the contacting portion is made thinner than the wall thickness t2 of the other portion in each of the tubes 610, 620. As a result, the weight of the tubes 610, 620 can be reduced.

Although the present invention has been fully described in connection with the preferred embodiment thereof with reference to the accompanying drawings, it is to be noted that various changes and modifications will become apparent to those skilled in the art. For example, in the above-described embodiment, both the tubes 610, 620 are wound around the case 330 while both the tubes 610, 620 are made contact. However, both the tubes 610, 620 can be directly brazed to the case 330 using a tube clad by brazing material on both side surfaces. In this case, manufacturing step can be made simple, and sealing performance is improved without using a seal member such as a ring.

In the above-described embodiment, the present invention is typically applied to the supercritical refrigerant cycle using $CO_2$ refrigerant. However, the present invention may be applied to a supercritical refrigerant cycle using refrigerant such as ethylene, ethane, or nitrogen oxide. Further, the present invention may be applied to a normal refrigerant cycle using flon as refrigerant, or may be applied to a heat pump.

In the above-described embodiment, the low-pressure tube 620 is placed between the high-pressure tube 610 and the case 330. However, the high-pressure tube 610 may be placed between the low-pressure tube 620 and the case 330.

In the above-described embodiment, one of the tubes 610, 620 contacts the case 330, while both the tubes 610, 620 are overlapped in the radial direction of the case 330. However, the tubes 610, 620 may contact the case 330 to be arranged in an axial direction (longitudinal direction) of the casing 330. Further, each of the tubes 610, 620 may be formed into the other shape such as a simple round shape.

In the above-described embodiment, in each of both the tubes 610, 620, the wall thickness t1 of the contacting position is made thinner than the wall thickness t2 of the other position. However, the wall thickness of any one contacting position may be set to be thinner than that of the other position.

Further, the structure of the pressure-reducing unit 300 is not limited to the above-described embodiment. The present invention may be applied to a thermal expansion valve used for a normal flon refrigerant cycle.

Such changes and modifications are to be understood as being within the scope of the present invention as defined by the appended claims.

What is claimed is:

1. A decompression device-integrated heat exchanger for a refrigerant cycle, comprising:

a pressure-reducing unit for reducing pressure of refrigerant in the refrigerant cycle; and a heat-exchanging unit integrated with said pressure-reducing unit, for performing heat-exchange between high-pressure refrigerant before being decompressed in said pressure-reducing unit and low-pressure refrigerant after being decompressed in said pressure-reducing unit, wherein:

said heat-exchanging unit includes a first tube through which the high-pressure refrigerant flows, and a second tube through which the low-pressure refrigerant flows;

said pressure-reducing unit has a case for defining a refrigerant passage therein; and said first and second tubes are disposed to be wound around said case while said first and second tubes are made contact.

2. The decompression device-integrated heat exchanger according to claim 1, wherein said second tube is disposed between said case and said first tube.

3. The decompression device-integrated heat exchanger according to claim 1, wherein:

said first tube has a first contacting portion contacting said second tube; and said first contacting portion has a wall thickness thinner than that of the other portion of the first tube.

4. The decompression device-integrated heat exchanger according to claim 1, wherein:

said second tube has a second contacting portion contacting said first tube; and said second contacting portion has a wall thickness thinner than that of the other portion of the second tube.

5. The decompression device-integrated heat exchanger according to claim 1, wherein:

said case has an approximate cylindrical shape; and said first and second tubes are disposed to be overlapped in a radial direction of said case while contacting said case.

6. The decompression device-integrated heat exchanger according to claim 1, wherein said pressure-reducing unit is for reducing pressure more than a critical pressure of refrigerant discharged from a compressor of the refrigerant cycle.

7. The decompression device-integrated heat exchanger according to claim 1, wherein said first and second tubes are directly bonded to said case by brazing.

8. The decompression device-integrated heat exchanger according to claim 2, wherein said second tube has both wall surfaces clad by a brazing material.

9. A refrigerant cycle comprising:

a compressor for compressing and discharging refrigerant;

a radiator for cooling refrigerant discharged from said compressor;

a decompression device-integrated heat exchanger for reducing pressure of refrigerant from said radiator and for performing heat-exchange between refrigerant before being decompressed and refrigerant after being decompressed; and an evaporator for evaporating refrigerant after being decompressed, wherein:

said decompression device-integrated heat exchanger includes a pressure-reducing unit in which pressure of refrigerant from said radiator is reduced, a case for accommodating said pressure-reducing unit, a first tube through which the refrigerant from said radiator flows, and a second tube through which refrigerant from said evaporator flows; and said first and second tubes are disposed to be connected to said case while said first and second tubes are made contact.

10. The refrigerant cycle according to claim 9, wherein said first and second tubes are wound around said case.

11. The refrigerant cycle according to claim 10, wherein said second tube is disposed between said case and said first tube.

12. The refrigerant cycle according to claim 10, wherein said first tube is disposed between said case and said second tube.

13. The refrigerant cycle according to claim 9, wherein:

said first tube has a first contacting portion contacting said second tube; and said first contacting portion has a wall thickness thinner than that of the other portion of the first tube.

14. The refrigerant cycle according to claim 9, wherein:

said second tube has a second contacting portion contacting said first tube; and said second contacting portion has a wall thickness thinner than that of the other portion of the second tube.

15. The refrigerant cycle according to claim 9, wherein:

said case has an approximate cylindrical shape; and said first and second tubes are disposed to be overlapped in a radial direction of said case while contacting said case.

16. The refrigerant cycle according to claim 9, wherein the pressure of refrigerant discharged from said compressor is more than a critical pressure of refrigerant.

17. The refrigerant cycle according to claim 9, wherein said first and second tubes are directly connected to said case by brazing.

* * * * *